US007494019B2

(12) United States Patent
Kessell et al.

(10) Patent No.: US 7,494,019 B2
(45) Date of Patent: Feb. 24, 2009

(54) MODULAR CANTILEVERED SHELVING ASSEMBLY AND METHOD

(75) Inventors: Steven M. Kessell, Loganville, GA (US); Paul J. Machado, Mississauga (CA); Francis Aloysius Kelly, Sandy Springs, GA (US); Bruce W. Hosker, Guelph (CA); Michael D. Potter, Dover, DE (US); Bobby L. Salter, Mount Holly, NC (US); Peterjohn R. C. Walters, Stockbridge, GA (US)

(73) Assignee: L&P Property Management Company, South Gate, CA (US)

( * ) Notice: Subject to any disclaimer, the term of this patent is extended or adjusted under 35 U.S.C. 154(b) by 52 days.

(21) Appl. No.: 10/511,381

(22) PCT Filed: Apr. 16, 2003

(86) PCT No.: PCT/US03/11698

§ 371 (c)(1),
(2), (4) Date: Oct. 14, 2004

(87) PCT Pub. No.: WO03/088782

PCT Pub. Date: Oct. 30, 2003

(65) Prior Publication Data

US 2005/0127017 A1 Jun. 16, 2005

Related U.S. Application Data

(60) Provisional application No. 60/373,510, filed on Apr. 18, 2002.

(51) Int. Cl.
*A47B 57/06* (2006.01)

(52) U.S. Cl. ..... 211/187; 211/186; 211/134; 108/108

(58) Field of Classification Search ..... 211/187, 211/134, 193, 186; 248/243, 242, 234, 239, 248/247; 108/1, 108, 187, 106, 50.02, 107, 108/110

See application file for complete search history.

(56) References Cited

U.S. PATENT DOCUMENTS 291,030 A 1/1884 Clapper (Continued)

OTHER PUBLICATIONS

"Metro Cantilevered Freestanding Shelving System" Brochure, Copyright © 1993 InterMetro Industries Corp.

(Continued)

*Primary Examiner*—Katherine Mitchell
*Assistant Examiner*—Colleen M. Quinn
(74) *Attorney, Agent, or Firm*—Michael Best & Friedrich LLP

(57) ABSTRACT

Some embodiments of the present invention disclose a shelving system having one or more support posts with a plurality of shelf connectors connected to the side of the support post. The connectors can be rigidly secured to the posts and/or can extend through the post and have a portion protruding from both lateral sides of the post. One or more shelves can attach to one or more of the shelf connectors at a variety of heights and extend in a variety of directions with respect tot the support post. These shelves can have a plurality of fingers for connection with laterally-extending support pins mounted to the support posts. Some embodiments also employ shelf brackets having bearing surfaces to distribute load from the shelves tot the vertical support posts.

5 Claims, 8 Drawing Sheets

U.S. PATENT DOCUMENTS

| | | | | | |
|---|---|---|---|---|---|
| 1,983,858 | A | | 12/1934 | Karnes | |
| 2,008,180 | A | | 7/1935 | Karnes | |
| 2,772,846 | A | * | 12/1956 | Skar | 248/243 |
| 2,788,949 | A | | 4/1957 | Gurries | |
| 2,790,559 | A | | 4/1957 | Stephenson et al. | |
| 3,057,483 | A | | 10/1962 | Derman | |
| 3,100,572 | A | | 8/1963 | Gingher et al. | |
| 3,184,068 | A | * | 5/1965 | Wende | 211/23 |
| 3,450,270 | A | | 6/1969 | Brown | |
| 3,517,623 | A | | 6/1970 | Goldstein et al. | |
| 3,561,608 | A | * | 2/1971 | Weider | 211/191 |
| 3,631,821 | A | * | 1/1972 | Zachariou | 108/152 |
| 3,730,108 | A | * | 5/1973 | Stroh | 108/108 |
| 4,116,509 | A | | 9/1978 | Smith | |
| 4,190,002 | A | | 2/1980 | Redemann | |
| 4,197,950 | A | * | 4/1980 | Ovitz, III | 211/134 |
| 4,285,436 | A | * | 8/1981 | Konstant et al. | 211/192 |
| 4,312,086 | A | | 1/1982 | Bianco | |
| 4,397,432 | A | * | 8/1983 | Resetar | 244/118.6 |
| 4,592,286 | A | * | 6/1986 | Trubiano | 108/108 |
| 4,623,065 | A | * | 11/1986 | Cooper | 211/187 |
| 5,074,422 | A | | 12/1991 | Holtz | |
| 5,161,701 | A | | 11/1992 | Berny | |
| D333,059 | S | | 2/1993 | Cohn et al. | |
| 5,205,630 | A | | 4/1993 | Welch | |
| 5,221,014 | A | | 6/1993 | Welch et al. | |
| D339,704 | S | | 9/1993 | Cohn et al. | |
| 5,263,595 | A | | 11/1993 | Hilstolsky | |
| 5,303,645 | A | | 4/1994 | Meacham | |
| 5,365,860 | A | | 11/1994 | Billington, III | |
| 5,518,127 | A | | 5/1996 | Warmack et al. | |
| 5,531,168 | A | | 7/1996 | Towfigh | |
| 5,647,650 | A | | 7/1997 | Daugherty et al. | |
| 5,655,740 | A | * | 8/1997 | Lazarus | 248/243 |
| 5,695,163 | A | | 12/1997 | Tayar | |
| 5,797,503 | A | | 8/1998 | Stevens | |
| 5,806,820 | A | * | 9/1998 | Simon | 248/243 |
| 5,915,803 | A | | 6/1999 | Daugherty | |
| 5,921,190 | A | | 7/1999 | Wood | |
| D415,365 | S | | 10/1999 | Nicklas | |
| 5,970,887 | A | * | 10/1999 | Hardy | 108/108 |
| 6,116,436 | A | | 9/2000 | Ferrucci et al. | |
| 6,267,064 | B1 | | 7/2001 | Ostertag et al. | |

OTHER PUBLICATIONS

"Super Erecta® Dunnage Racks" Catalog Section 10, Metro Food Service Catalog, 1995.
"Metro Work Space Adjustable Workstations" Brochure, 2001.

* cited by examiner

MODULAR CANTILEVERED SHELVING ASSEMBLY AND METHOD

CROSS-REFERENCE TO RELATED APPLICATIONS

This application claims the benefit and priority of International Patent Application No. PCT/US2003/011698, filed Apr. 16, 2003, which claims priority of U.S. Provisional Patent Application No. 60/373,510 filed on Apr. 18, 2002.

FIELD OF THE INVENTION

The present invention relates to shelves, racks, and workstations, and more particularly to shelves, racks, and workstations that are cantilevered for supporting items or for supporting work surfaces.

BACKGROUND OF THE INVENTION

An important function of most shelving and rack systems and workstations is the ability to increase storage and working space. A number of improvements to shelving and rack systems and workstations have improved the ability of such structures to perform these functions. However, significant limitations still exist in the design and assembly of conventional shelving systems, racks and workstations. These limitations are most apparent in highly competitive industries in which space, assembly and adjustment time, and reliability are at a premium. One such industry is the food service industry, where each of these factors plays a significant role in the success and profitability of a business. Therefore, although the present invention (and the problems that exist in conventional shelving systems, racks, and workstations referred to below) is discussed with reference to the food service industry, it should be noted that the present invention is applicable to and solves similar problems in any industry employing shelving systems, racks, and workstations. Examples of such industries include retail stores in which merchandise is displayed and stored, laboratories and shops where storage and work space are needed, and warehouses in which any type of product is organized and stored.

The food service industry is extremely competitive and relies upon efficiency, timeliness and service as cornerstones to distinguish between individual food service businesses. Accordingly, increased resource utilization is a primary goal for most food service businesses, and can significantly impact profitability of such businesses. For example, kitchen work space and/or food storage space is an important resource in the food service industry because of the limited space typically available for such purposes. Varying the sizes and layouts of kitchen and storage space calls for varying types, kinds and sizes of shelves, racks, and workstations. These structures typically consist of vertical supports, horizontal storage and support structures, and connecting elements for connecting the horizontal storage and support structures to the vertical supports.

Hereinafter, the term "shelf" or "shelves" refers to any storage and support surface used to support product or upon which work can be performed above ground level. In the food service industry for example, such functions include the storage of food, packaging, cleaning supplies and equipment, and support for food preparation, cooking, serving, and dishwashing equipment and operations.

In the food service industry, it is normally desirable for shelving systems and workstations to be inexpensive, modular, adjustable, easy to assemble and disassemble, easy to clean and reliable. Conventional shelving systems and workstations do not always satisfy such criteria or provide the optimal features necessary to accomplish the goals desired. Specifically, many conventional shelving systems and workstations are often expensive, difficult to clean, assemble, disassemble, and adjust. Also, conventional systems often lack the modularity necessary to meet a wide variety of environments or prove to be unreliable.

For obvious reasons, it is an important feature that food service shelving systems and workstations be easy to clean. However, many conventional shelving systems and workstations employ vertical support posts having a generally C-shaped cross section with one or more internal cavities. Because the internal cavities are difficult to access, such posts are difficult to clean. In addition, the support posts of many conventional shelf systems and workstations have slots and other apertures for connecting shelves thereto. These apertures are typically small, and do not facilitate easy or thorough cleaning of interior locations which need to be cleaned.

As mentioned above, the assembly and disassembly of many conventional shelving systems and workstations is time-consuming and difficult. This inefficiency is compounded in many cases in which the shelving systems and workstations must be frequently moved, requiring the workstations to be partially or fully assembled and disassembled. Also, many conventional shelving systems and workstations have shelves constructed of several elements that must be assembled. In many designs, these shelves include two side brackets, a cross member connecting the side brackets, and connecting elements for connecting the shelves to the support posts. Assembling and disassembling such shelves can add significant time to the overall assembly process.

In many conventional shelving systems and workstations, shelves are welded or otherwise permanently attached to vertical support posts, making the shelving system or workstation a single integral structure (or defining large subassemblies in such shelving systems and workstations). This makes the shelving systems and workstations more difficult to move due to the size and weight of the integral assemblies or subassemblies. Also, by permanently attaching the shelves to support posts, the shelving systems and workstations can only be arranged in a single configuration. Other conventional shelving systems and workstations assemble shelves and support posts by using mechanical fasteners such as screws, bolts, and pins. Assembling the shelving systems and workstations with mechanical fasteners can be difficult and time consuming, and is often undesirable because tools are needed to properly assemble the shelving systems and workstations.

Still other conventional shelving systems and workstations include other connecting elements for connecting shelves to support posts. For example, some shelving systems and workstations employ pins welded incrementally along the back surface of vertical support posts. Shelves are mounted to these pins by saddle brackets (brackets that are C-shaped and surround the vertical support posts on the front, side and back surfaces thereof). Although popular, the use of such saddle brackets makes assembly of the shelving systems and workstations difficult for a number of reasons. Specifically, these saddle brackets must often be mounted on each vertical support post from the side of the shelving system or workstation, which can be a difficult procedure due to tight space constraints adjacent to the shelving system or workstation.

Many types of conventional shelf brackets (including many saddle brackets) also present problems and inefficiencies to assemblers of the associated shelving systems and workstations. In particular, the steps required to assemble the shelves and brackets are often difficult and time consuming.

For example, many brackets (including saddle brackets) are difficult and time consuming to assemble to shelves and to connect to vertical support posts because they provide no immediate visual feedback to confirm that the brackets have been properly connected to the vertical support posts. This is because many conventional brackets connect to pins extending from the rear surface of the vertical support posts. Therefore, a person assembling the workstation from the front or the side cannot see the back surface of the vertical support posts where the brackets mount to the pins. In many cases, the assembler may incorrectly believe that the saddle brackets are properly mounted with the pins. Because many shelving systems and workstations are large and heavy and are often used to support significant loads, this assembly error can result in serious injury and damage to equipment.

Another important issue relevant to shelving systems and workstations is strength and reliability. Shelving systems and workstations that are strong, sturdy, and reliable are highly desirable in the food service business and in any other industry. Unfortunately, however, many conventional shelving system and workstation designs sacrifice strength and reliability for other features, including manufacturability, material and costs savings, adjustability, and other features. By way of example only, C-channel vertical support posts are commonly used for purposes of cost and adjustability of elements connected at various positions therealong. However, such support posts can be significantly weaker than support posts having other shapes (e.g., round or rectangular closed tubular support posts).

As another example, the shelves of many conventional shelving systems and workstations are assembled from multiple elements, which can present strength, assembly, and stability issues. In some designs, the multiple-piece shelves typically have two brackets (one bracket mounted to each vertical support post) and a shelf that lies across the bracket tops. Improper assembly of the shelf and brackets can cause the shelf to fall or break in use.

Other conventional shelving systems and workstations have shelves that mount to the vertical support posts by mechanical fasteners such as screws and bolts. Mechanical fasteners can be unreliable if they are not sufficiently tightened or are improperly tightened, and introduce a far greater likelihood of assembly error than other manners of mounting shelves.

Still other conventional shelving systems and workstations attempt to address this issue by employing pins or posts welded to one surface of the vertical support posts and to which shelf brackets can be mounted. However, by welding the pins to only one surface of the vertical support posts, the entire weight of each shelf is transferred to the weld. This concentration of weight raises undesirable weld stress issues that reduce the attractiveness of such shelving system and workstation designs.

Many conventional shelving systems and workstations have limited weight-bearing capacity. In some cases, the shelving systems and workstations are constructed of light gauge shelves and light-gauge vertical support posts that are incapable of supporting large amounts of weight. Also, some conventional workstations have weak connectors used to connect shelves to the vertical support posts. Such design features restrict these shelving systems and workstations to light-duty use, and can limit shelving system and workstation life expectancies.

In light of the problems and limitations of the prior art described above, a need exists for shelving systems and workstations that are easy to clean thoroughly, are easy and quick to assemble, provide an adjustable and reliable connection between shelves and vertical support posts, and can support a relatively large amount of weight. Each preferred embodiment of the present invention achieves one or more of these results.

SUMMARY OF THE INVENTION

In order to address issues regarding the strength and ease of cleaning of shelving systems and workstations, some embodiments of the present invention employ shelf connectors located on, extending through, and preferably rigidly secured to the vertical supports rather than only being welded to an external face of the vertical supports. These shelf connectors can take a number of different forms, and in some preferred embodiments are pins. Each pin can have a portion protruding from both lateral sides of a vertical post. The use of pins on the vertical support posts (to which shelf brackets can be attached) results in a vertical post design that has no voids or apertures in which dust, dirt, and debris can collect and which provides external surfaces which are relatively easy to clean.

As discussed above, it is also desirable to have a workstation that is easy and quick to assemble. In this regard, some preferred embodiments of the shelving system and workstation according to the present invention have shelves that are integral with respect to their brackets used to attach the shelves to the vertical support posts. These shelves can have a plurality of fingers for connection with laterally-extending support pins mounted to the vertical support posts. When mounting the shelves to the posts, immediate visual feedback is provided to confirm proper mounting of the fingers to the pins, thereby greatly simplifying and increasing the reliability of shelving system and workstation assembly.

Some embodiments of the present invention also employ shelf brackets having bearing surfaces that can significantly increase the load-bearing capacity of the shelves and/or can improve the stability of the shelves and associated shelving systems and workstations. More particularly, the shelves in such embodiments connect to vertical support posts as described above and have bearing surfaces that contact the vertical posts when the shelves are mounted thereto. The bearing surfaces help to distribute load from the shelves to the vertical support posts. Also, weight on the shelves can transmit large torsional forces upon the shelves (such as at the shelf connections with the vertical support posts). The bearing surfaces described above can reduce the large torsional forces on the shelf and can help to distribute these forces to increase the load-bearing capacity of the shelves.

Further objects and advantages of the present invention, together with the organization and manner of operation thereof, will become apparent from the following detailed description of the invention when taken in conjunction with the accompanying drawings, wherein like elements have like numerals throughout the drawings.

BRIEF DESCRIPTION OF THE DRAWINGS

The present invention is further described with reference to the accompanying drawings, which show preferred embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTIONS OF THE PREFERRED EMBODIMENTS

Figure 1:
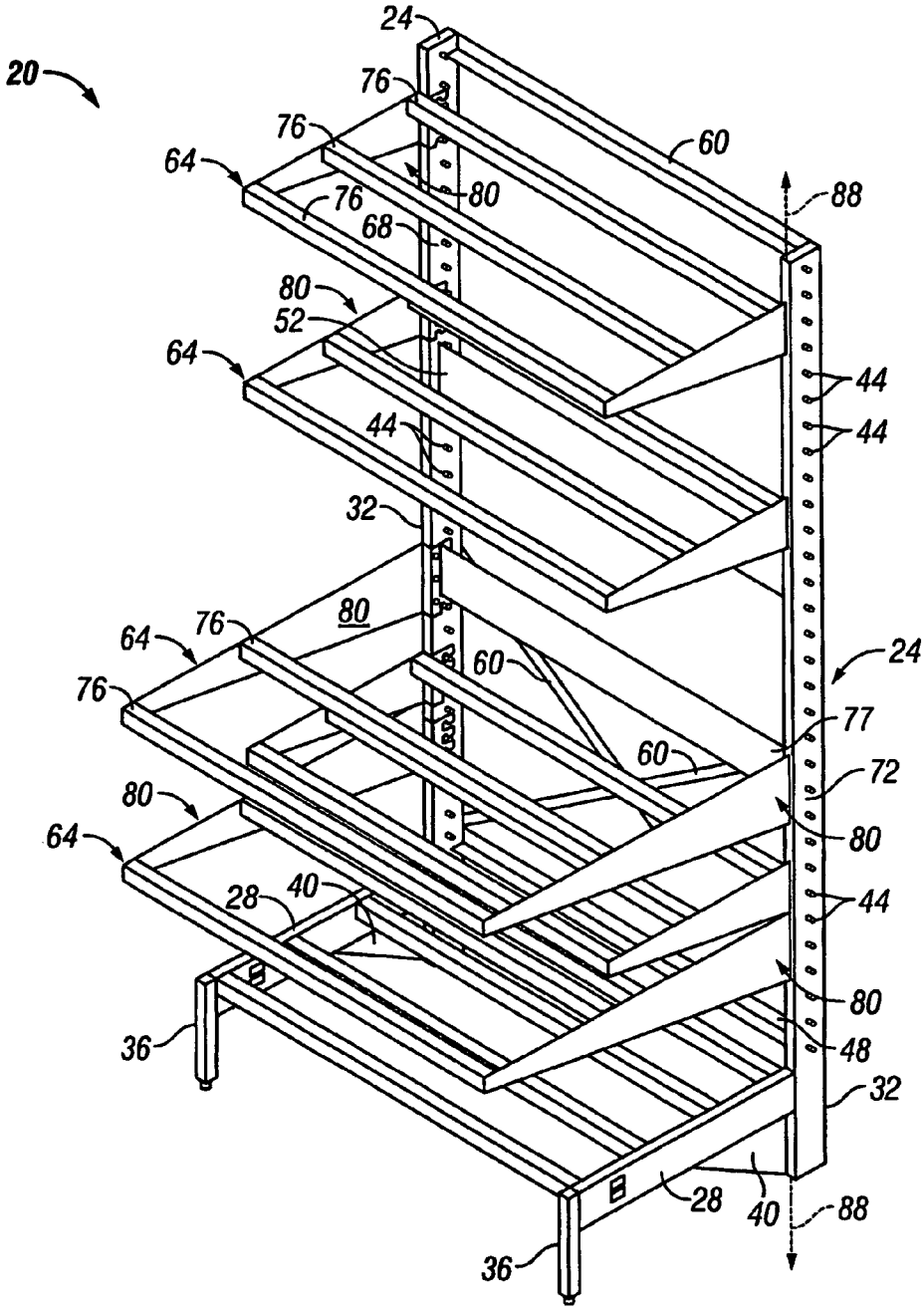
FIG. 1 is a front perspective view of a workstation according to a first preferred embodiment of the present invention.
Figure 2:
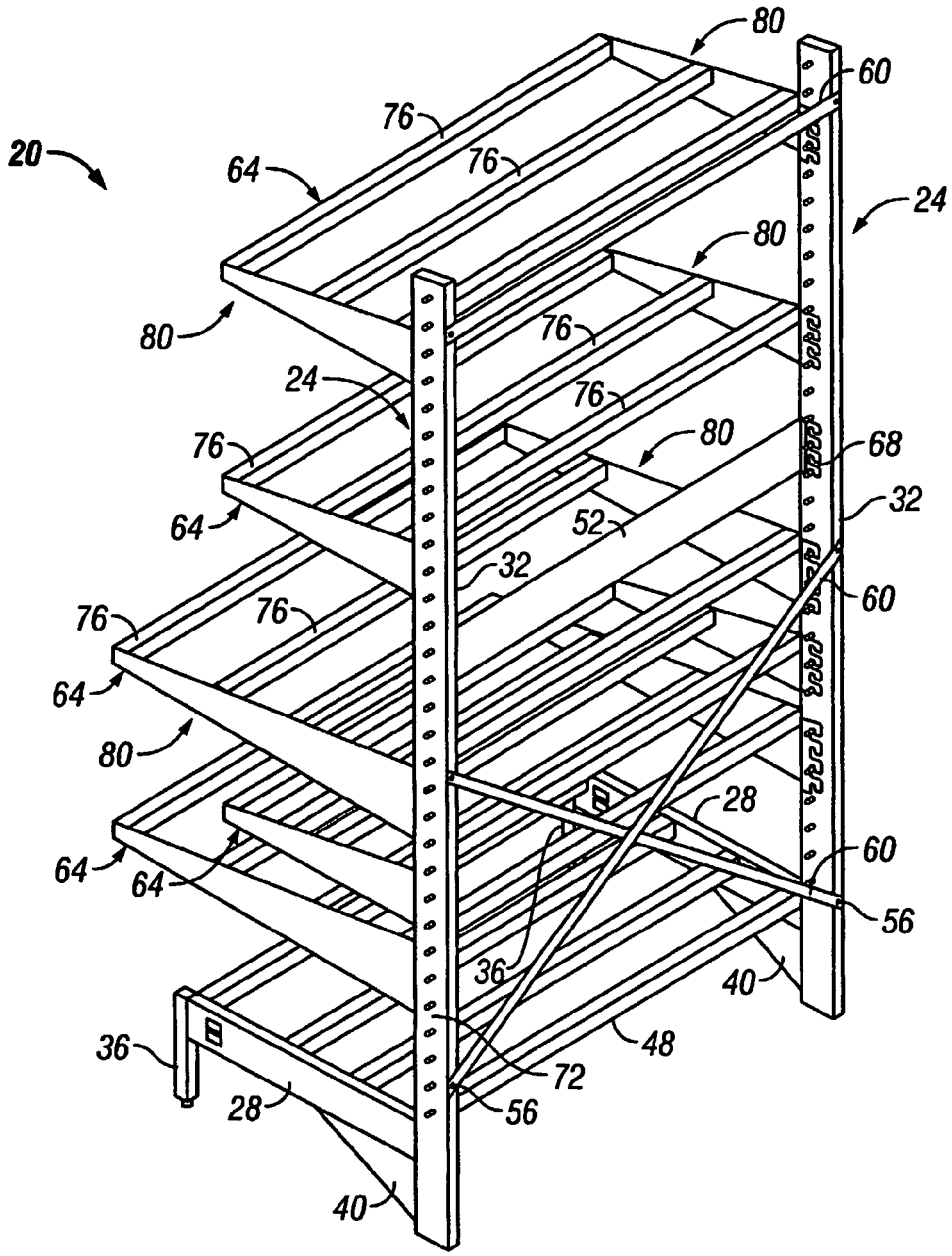
FIG. 2 is a rear perspective view of the workstation illustrated in FIG. 1.

With reference first to FIGS. 1 and 2, a preferred embodiment of the present invention is illustrated with reference to a modular workstation 20. Although the structure shown in FIGS. 1 and 2 is a workstation (i.e., providing support for one or more surfaces upon which users can perform work of any kind), it should be noted that the following description of the modular workstation 20 and its alternative embodiments applies equally to shelving systems, rack systems, and any other structure which supports surfaces for working or for storing or displaying product of any type. Accordingly, the workstations 20 illustrated in the figures and described below are presented only by way of example, and do not indicate that the principles of the present invention are limited in applicability to such workstations.

The workstation 20 shown in FIGS. 1 and 2 is suitable for use in any workstation environment. As used herein, the term "workstation environment" means any location where work is performed on an elevated surface. Examples of workstation environments include without limitation restaurants, fast food outlets, grocery stores, factories, hardware stores, butcher shops, laboratories, and the like.

The workstation 20 in the illustrated preferred embodiment includes vertical support posts 24 that are vertically erected with respect to a ground surface (not shown). Each post 24 includes a cantilevered base member 28 and an upright member 32 that are generally perpendicular to each other. The upright member 32 preferably contacts the ground surface and extends generally vertically, while the base member 28 preferably extends from the upright member 32 in a direction generally parallel to the ground surface. In some embodiments, the base member 28 includes a support leg 36 that contacts the ground surface a distance from the upright member 32 and provides stability for the post 24. For additional strength and stability of the base member 28 and the upright member 32, a gusset 40 can be positioned between the base member 28 and the upright member 32 and can be connected to both members 28, 32 in any conventional manner. Preferably, the posts 24 include a plurality of support pins 44 for mounting items to the posts 24 as will be described in greater detail below.

Although the posts 24 preferably have base members 28 that are integral with or connected to the upright members 32, the posts 24 can instead be defined solely by upright members 32 vertically supported in any other manner, such as by feet that extend from the bottoms of the posts 24 to provide an increased footprint of the upright members 32, by being secured to other structure behind or adjacent to the upright members 32 (such as a wall or framing), and in still other manners. In addition, other relative positions (non-perpendicular) of the base and upright members 28, 32 are possible, as well as other orientations of the base member 28 with respect to the ground.

If desired, the workstation 20 can be provided with one or more stretchers 48, 52 laterally connecting the upright members 32 together. In the illustrated preferred embodiment for example, the upright members 32 are connected together by a lower stretcher 48 and an upper stretcher 52. The stretchers 48, 52 can be connected to the upright members 32 in any manner, such as by bolts, screws, rivets, pins, clips, and other conventional fasteners 56, by fingers, headed posts, hooks, or other extensions of the stretchers 48, 52 extending into mating connectors or apertures in the upright members 32 (and vice versa), or in any other manner desired. For example, the upper stretcher 52 in the illustrated preferred embodiment is mounted to the posts 24 by way of the support pins 44 as will be described in greater detail below. Although the lower and upper stretchers 48, 52 have been described with the above-noted mounting positions and mounting elements, any number of stretchers 48, 52 (and in some cases, even no stretchers) can be connected to the upright members 32 at any location(s) along the upright members 32 in order to connect the upright members 32 together.

If desired, the workstation 20 can include any number of additional frame members extending between and connecting the upright members 32 for further support, including without limitation cross supports 60 coupled to and extending diagonally between the upright members 32. Two such supports 60 are shown in FIGS. 1 and 2. The cross supports 60 can be connected to the upright members 32 in any conventional manner, including those mentioned above with regard to the connection of the lower and upper stretchers 48, 52 to the upright members 32. Preferably, opposite ends of each cross support 60 are connected to the upright members 32.

Figure 3:
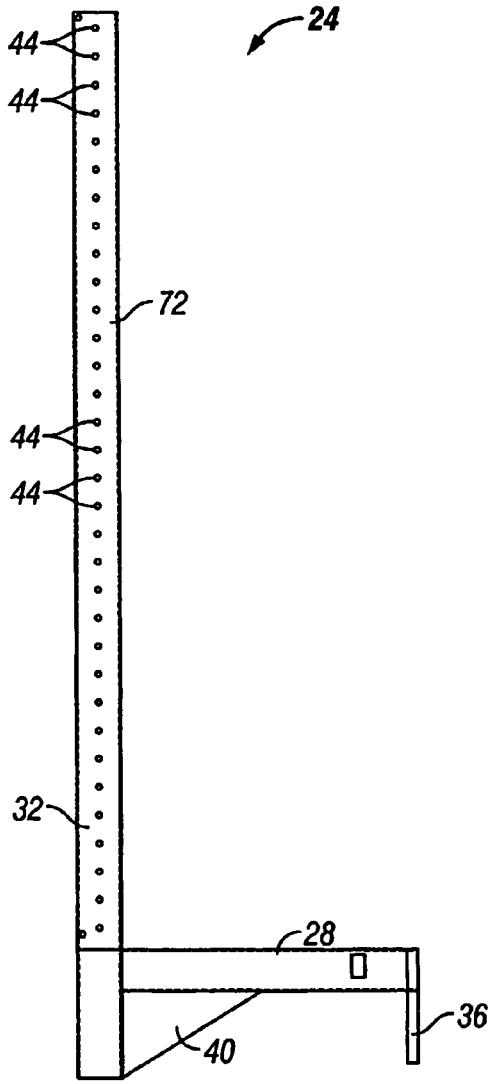
FIG. 3 is a side view of a vertical support post and base illustrated in FIG. 1.
Figure 4:
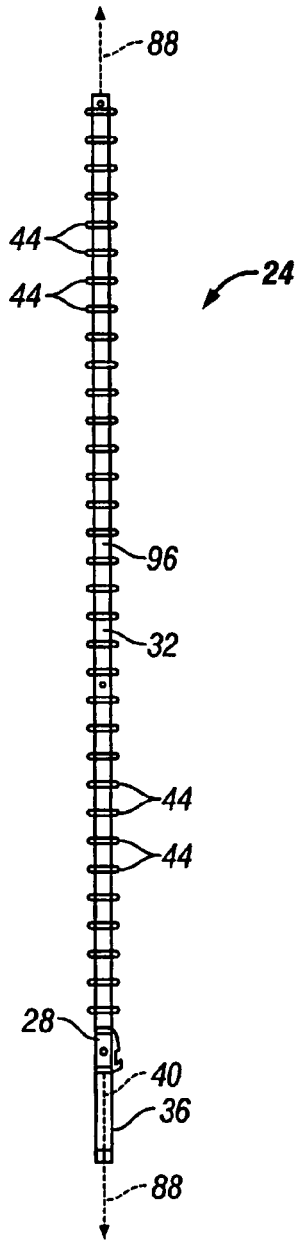
FIG. 4 is a front view of the vertical support post and base illustrated in FIG. 3.

FIGS. 3 and 4 provide additional views of one of the posts shown in FIGS. 1 and 2. In this preferred embodiment, support pins 44 are mounted incrementally along the upright member 32 of the post 24. The support pins 44 can be mounted at any regular or irregular distance from one another along any length or lengths of the post 24. However, in some preferred embodiments, the support pins 44 are mounted at regular intervals along the majority of the post's length. Preferably, the support pins 44 are mounted between 1" and 4" apart (measured from pin center-to-center). More preferably, the support pins 44 are mounted between 2" and 4" apart. However, the inventors have found that a balance between excellent shelf adjustability and mounting strength results from support pins 44 mounted at 2" intervals along part or all of the length of the post 24.

The pins 44 can take any shape desired, such as pins having a round or substantially round cross-sectional shape as illustrated in the figures, a rectangular cross-sectional shape, an irregular cross-sectional shape, and the like. In addition, the pins 44 can have any size and diameter desired. In some embodiments, the pins 44 have a round cross-sectional shape and are approximately 5/16" (0.3125") in diameter.

The pins 44 preferably extend laterally through the posts 24 as shown in FIGS. 1-4. Specifically, each pin 44 is preferably a single piece that extends laterally through the post 24 and has a portion of the pin 44 protruding laterally from both sides 68, 70 of the post 24 (i.e., protruding from the left and right side surfaces 68, 70 of the post 24 with respect to a viewing position in front of and facing the workstation 20). Preferably, each pin 44 is welded to the post 24 on the left side surface 68 or the right side surface 72. More preferably, each pin 44 is welded to the post 24 on both the left and right side surfaces 68, 72 of the post 24. Although the pins 44 are preferably welded to both lateral sides 68, 72 of the post 24, it should be noted that pins 44 extending through and past both sides 68, 72 of the post 24 can be secured to the post 24 in a number of other manners, including without limitation by being press-fit or by otherwise having an interference fit within apertures on both sides 68, 72 of the post 24, by being fastened to the post 24 with one or more fasteners (e.g., cotter pins, setscrews, or other fasteners extending through at least part of each pin 44 on opposite sides of the post 24 to prevent removal of the pins 44), by being threaded into a threaded aperture extending through the post 24, by a snap-fit into the side apertures 68, 72 of the post, by a keyed or inter-engaging connection between the pins 44 and side walls 68, 70 (e.g., one or more teeth, fingers, or other protrusions in the side apertures 68, 72 mating with one or more grooves, slits, or other apertures in the pins 44, and vice versa), and the like. One having ordinary skill in the art will appreciate that the pins 44 can be secured in the post 24 in a number of other manners, each one of which falls within the spirit and scope of the present invention. Preferably however, the engagement of the pins 44 leaves no externally-exposed cavities or other apertures that would otherwise make cleaning of the workstation 20 difficult.

Although pins 44 extending through the posts 24 as described above are most preferred for reasons of strength and reliability, other embodiments of the present invention employs pins 44 that are secured to either or both sides 68, 72 of the posts 24 rather than pins 44 extending through the posts 24. In such embodiments, the pins 44 can be secured to the posts 24 in any manner desired, including those described above with reference to the pins 44 in the preferred embodiments illustrated in the figures. Most preferably however, pins 44 secured to either or both sides 68, 72 of the posts 24 are welded to the posts 24.

With continued reference to FIGS. 1 and 2, the workstation 20 preferably includes one or more shelves 64 having any size desired. In some preferred embodiments (including those shown in the figures), the shelves 64 are mounted to the posts 24 by way of the support pins 44 as will be discussed below.

Figure 5:
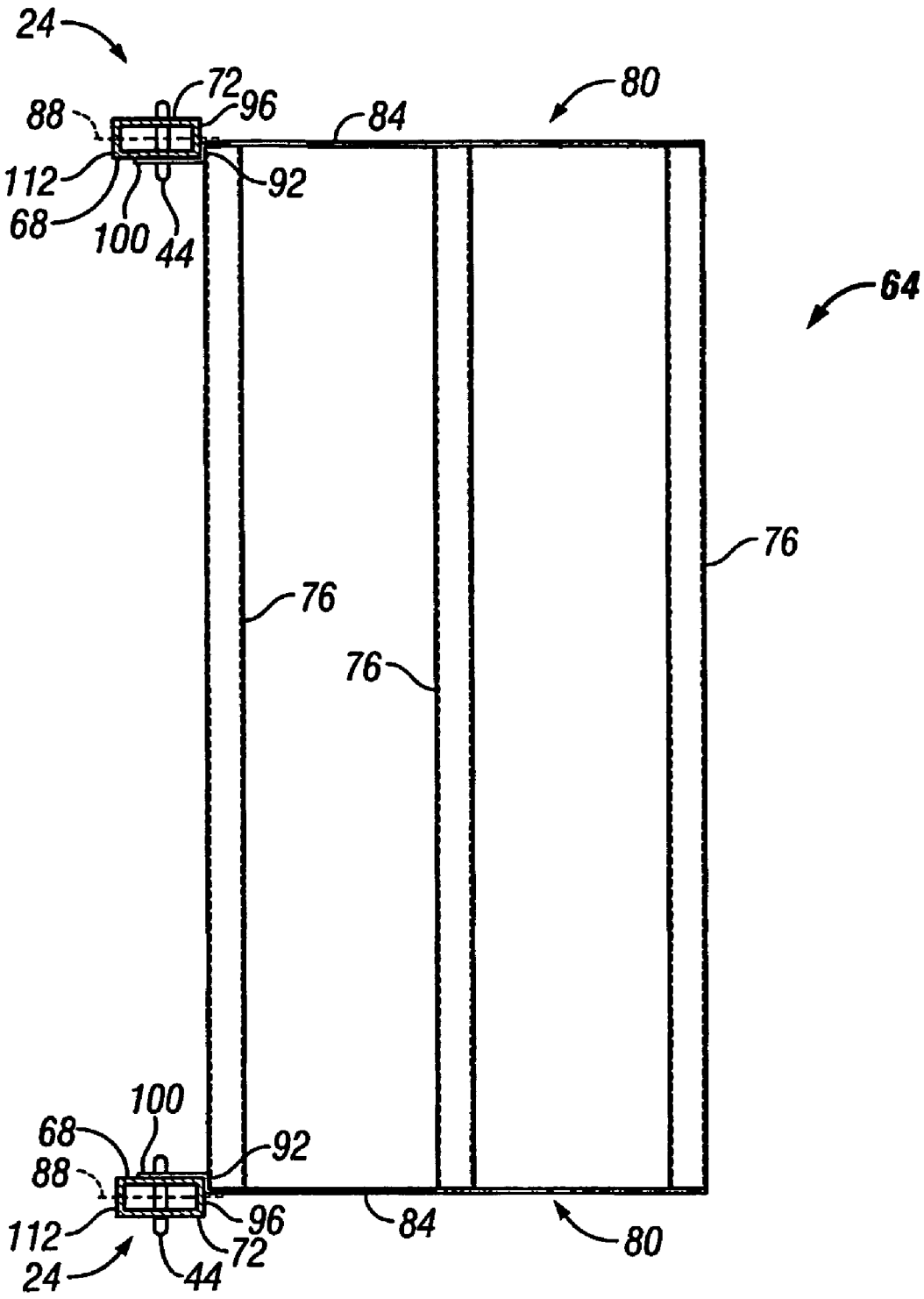
FIG. 5 is a top view of a shelf illustrated in FIG. 1, shown mounted to sectioned vertical support posts.
Figure 6:
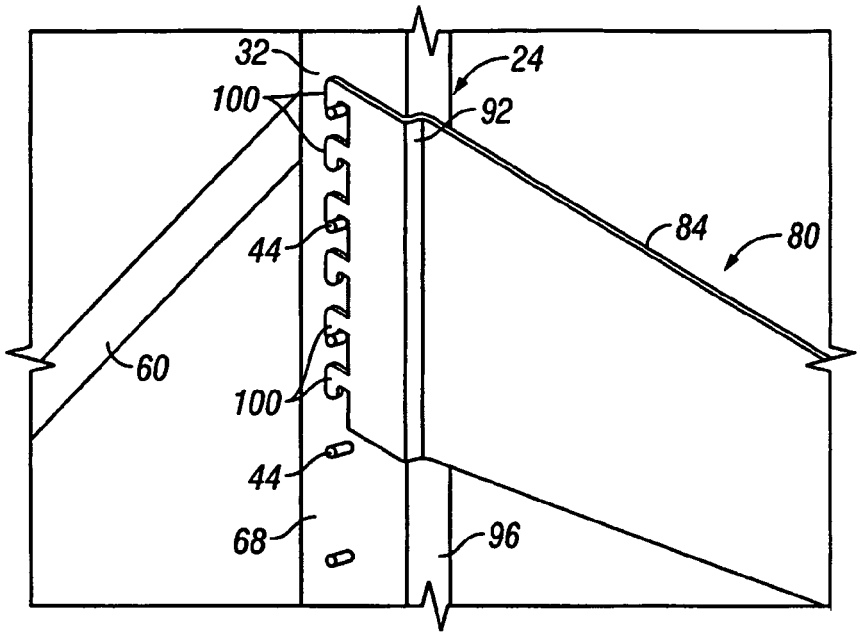
FIG. 6 is a partial perspective view of the workstation illustrated in FIG. 1.
Figure 7:
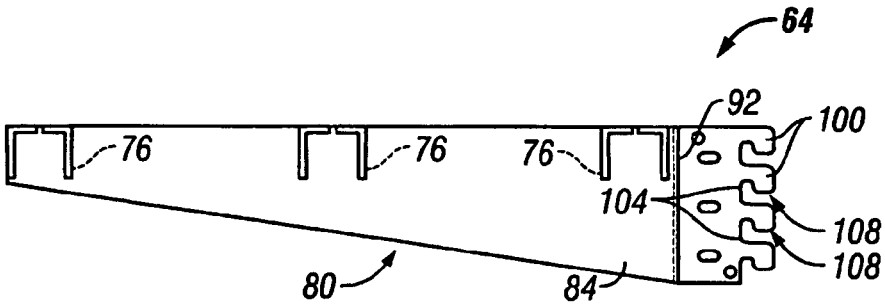
FIG. 7 is a side view of the shelf illustrated in FIG. 5, shown without the sectioned vertical support posts.

A preferred embodiment of a shelf 64 used in the workstation 20 of the present invention is illustrated in FIGS. 5-7. However, it should be noted that other shelves 64 having different sizes and shapes can employ the same features described hereafter. In some preferred embodiments, the shelf 64 is a single integral piece having one or more cross members 76 and side brackets 80. The cross members 76 preferably extend between the side brackets 80 and provide a support surface for the shelf. Alternatively, the side brackets 80 can be connected by a frame, sheet, series of bars or poles, mesh, screen, or any other element extending between the side brackets 80 for purposes of supporting weight, for supporting surface covers upon which to work or store and display articles, and/or for securing the side brackets 80 with respect to one another. In some embodiments, the side brackets 80 are connected by one or more cross members 77 near a location where the shelf is mounted to the support posts 24. Such a cross member 77 is illustrated in FIG. 1 by way of example only.

As an alternative to cross members 76 that are integral with the side brackets 80 (such as by welding, soldering, brazing, or by being stamped, pressed, bent, extruded, molded, cast, or otherwise formed out of a single element), the cross members 76 can be assembled to the side brackets 80 in a number of different manners. For example, the cross members 76 can be connected to the side brackets 80 with fingers, screws, pins, inter-engaging elements, or in any other manner desired, including those described above with reference to the connections of the stretchers 48, 52 to the upright members 32.

Preferably, each side bracket 80 includes or defines a flange 84 to which the cross members 76 are connected. Although any orientation between the flange 84 and posts 24 can exist, the flange 84 is preferably generally perpendicular to the plane shared by the posts 24. Depending at least partially upon the manner in which the flanges 84 are connected to the upright members (as will be described in greater detail below), the flanges 84 can extend from the posts 24 at any relative angle with respect to the posts 24. In the illustrated embodiment and in some other preferred embodiments, the flanges 84 extend generally away from a centerline 88 of the posts 24.

Some preferred embodiments of the flanges 84 are shaped to contact and bear against a surface of the upright members 32. In these embodiments, the brackets 80 preferably include bearing surfaces 92 that are generally perpendicular to the flanges 84 and are generally parallel to a front surface 96 of the upright members 32. In such embodiments, each bearing surface 92 preferably extends laterally from the end of the flange 84 toward either side wall 68, 70 of the upright members 32 (or toward both side walls 68, 70). However, with respect to a workstation 20 having upright members 32 supporting ends of shelves 64 connected thereto (see FIGS. 1 and 2), the bearing surface 92 preferably extends laterally inward (in a direction toward the other upright member 32 and bracket 80).

The bearing surface 92 can extend across any part of the front surface 96 of the upright members 32, such as laterally from one side wall 68 of the upright member 32 to the other 70, or laterally across any portion of the width of the front surface 96. In the illustrated preferred embodiment, the bearing surface 92 extends laterally from the midpoint or centerline 88 of the upright member 32 to the inside wall 68 of the upright member 32. In each flange embodiment having a bearing surface as just described, when the shelf 64 is mounted to a post 24, the bearing surface 92 contacts a wall (e.g., a front surface 96) of the post 24 and thereby prevents torsional rotation of the shelf 64. Torsional rotation of the shelf 64 is typically created by the weight of the shelf 64 and by placing weight upon the shelf 64. The more weight that is placed upon the shelf 64, the larger the torsional forces that will be exerted upon the shelf 64. Torsional forces created from the weight of the shelf 64 and from weight upon the shelf 64 can be better supported by distributing the forces to a wall of the upright members 32 via the bearing surfaces 92. In this regard, forces are preferably distributed across part or all of the bearing surface 92 by virtue of the shape of the shelf flanges 84. In the illustrated preferred embodiment, these upright member walls are the front walls 96 of the upright members 32.

Each bracket 80 preferably also extends at least partially along a side of an upright member 32 and for connection thereto. This manner of connection can take any number of forms, including without limitation one or more pins, headed posts, teeth, fingers, or other protrusions on the bracket 80 extending into one or more apertures in the upright member 32 (and vice versa), inter-engaging elements or features of the bracket 80 and the upright member 32, by one or more bolts, screws, or other fasteners, and the like. In some highly preferred embodiments however, the brackets 80 include a plurality of rearwardly-extending fingers or hooks 100 that curve downward to define a plurality of cavities 104 that open upward. The fingers or hooks 100 can be spaced at any regular or irregular intervals. For example, in the illustrated preferred embodiment, the hooks 100 are spaced from each other on 1" centers. The hooks 100 and openings 104 preferably work collectively to form spaces to receive and secure the pins 44 of the upright members 32 (described above) to mount the shelf 64 to the posts 24 and to prevent vertical or downward movement of the shelf 64. In this regard, the hooks 100 and openings 104 of the brackets 80 receive and hold portions of the pins 44 protruding from the surfaces of the posts 24.

The shelf 64 is preferably mounted to the posts 24 by positioning the shelf 64 in front of the posts 24 at the desired height of the shelf 64. With reference to the illustrated preferred embodiments shown in the figures, the hooks 100 on the brackets 80 are positioned between the inside surfaces 68 of the posts 24—that is, the hooks 100 are inboard of the posts 24. In alternative embodiments however, the flanges 84 can be shaped so that the hooks 100 on the brackets 80 are positioned on the outboard surfaces 70 of the posts 24. Next, the shelf 64 is preferably moved toward the posts 24, such that the hooks 100 move between the posts 24 (or on the outboard sides of the posts 24 in the alternative embodiments just mentioned), and the bearing surfaces 92 contact the front surfaces 96 of the posts 24. The pins 44 preferably slide through slots 108 beneath the hooks 100 and contact the brackets 80 below the openings 104. The shelf 64 can then be moved downward until the pins 44 slide into the openings 104 and contact the hooks 100. At this time, the shelf 64 is locked in place and cannot move or rotate downward (for reasons discussed above).

The procedure for mounting the shelves 64 discussed above is very reliable. By mounting the shelves 64 according to this procedure, immediate visual feedback is provided to confirm proper mounting of the hooks 100 to the pins 44. The immediate visual feedback is enabled by the connections of the brackets 80 to the sides of the uprights 32 rather than to the rear of the uprights 32 as is found in the prior art. This greatly decreases the chance of the shelf 64 being mounted improperly and causing injury and/or damaged equipment.

If desired, the shelves 64 can be provided with shelf covers (not shown) that can rest upon and/or can be connected to the top of the shelves 64 in any conventional manner. In some embodiments, the shelf covers provide a flat support surface and working surface (rather than the cross members 76). The shelf covers can come in a variety of shapes, sizes and materials depending upon the application of the workstation 20.

Figure 8:
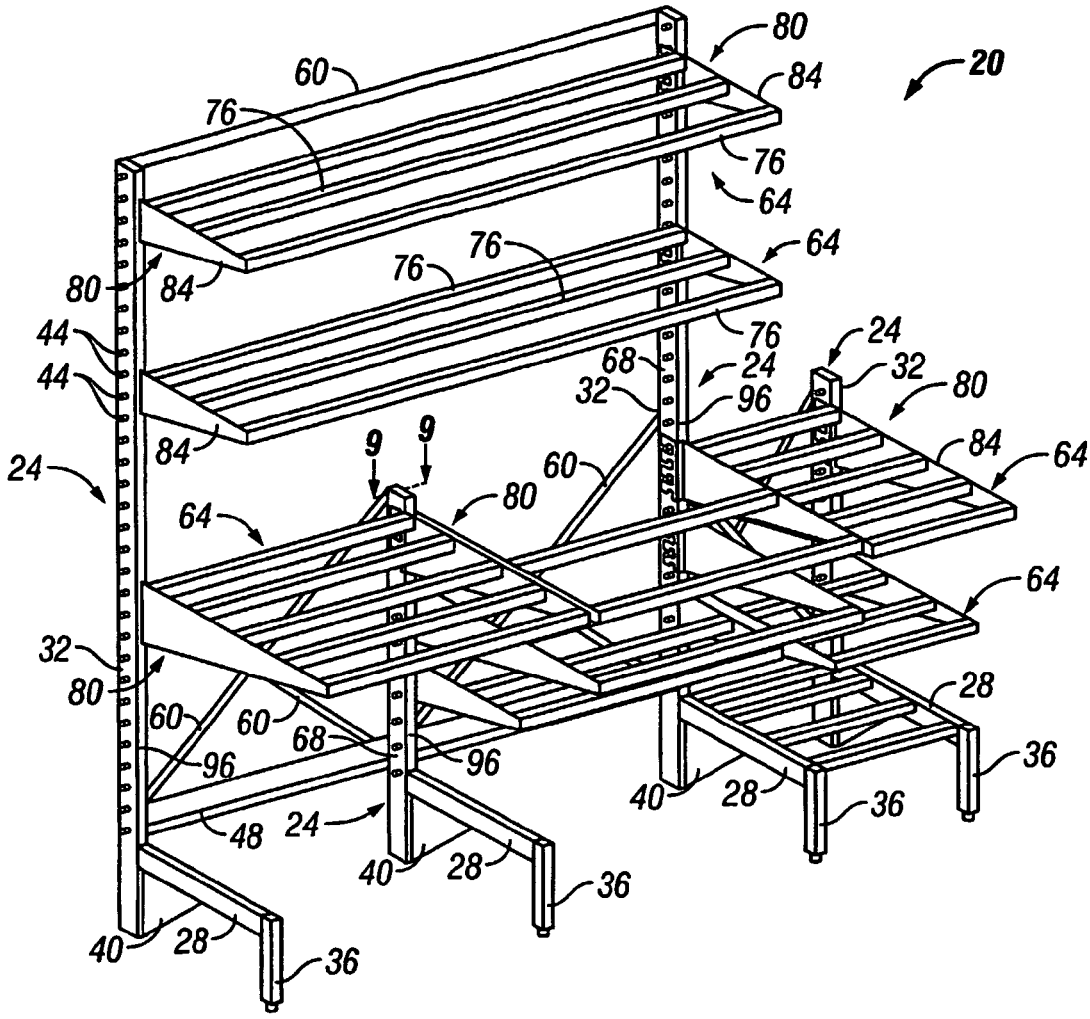
FIG. 8 is a front perspective view of a workstation according to a second preferred embodiment of the present invention.
Figure 9:
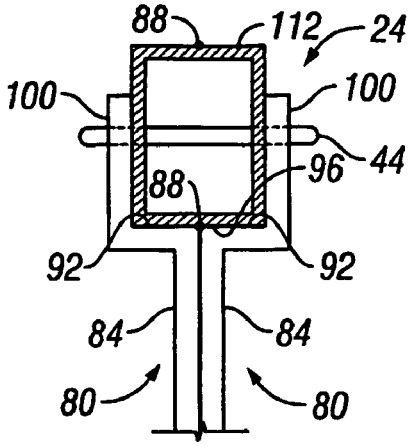
FIG. 9 is a detail sectional view of a shelf bracket and support connection arrangement according to a third preferred embodiment of the present invention.

Referring to FIGS. 8 and 9, some embodiments of the workstation 20 according to the present invention provide improved modularity by enabling shelves 64 to be connected to vertical support posts 24 on either or both sides 68, 72 of the posts 24. Even greater modularity is possible by enabling shelves 64 to be connected in this manner at the same height on the support posts 24, in which case two shelves on opposite sides 68, 72 of the same support post 24 can utilize the same pins 44 for connection to the post 24.

As discussed above, the flanges 84 of the shelves 64 in a number of preferred embodiments extend generally away from the centerline 88 of the posts 24. Therefore, by mounting shelves 64 on opposite sides 68, 72 of the same post 24 as just described, the flanges 84 on the two shelves 64 can extend generally adjacent to one another from the centerline of the post 24. In some cases, two adjacent shelves as described above can therefore be mounted to the same post 24 to define a substantially continuous shelf. Therefore, the shelves 64 and flanges 84 can have little to no gap therebetween, resulting in a substantial space savings when compared to conventional systems in which a gap exists between adjacent shelves and shelf brackets. Also, conventional workstations commonly employ vertical support posts that can only support shelves on one side of the vertical support posts. If another shelf is desired adjacent to and at the same height as the first shelf in such workstations, a second vertical support post is needed beside the first vertical support post. Therefore, existing workstations typically require several more vertical support posts than the present invention, have a gap between adjacent shelves, and occupy a larger footprint as a result of the additional vertical support posts.

Figure 10:
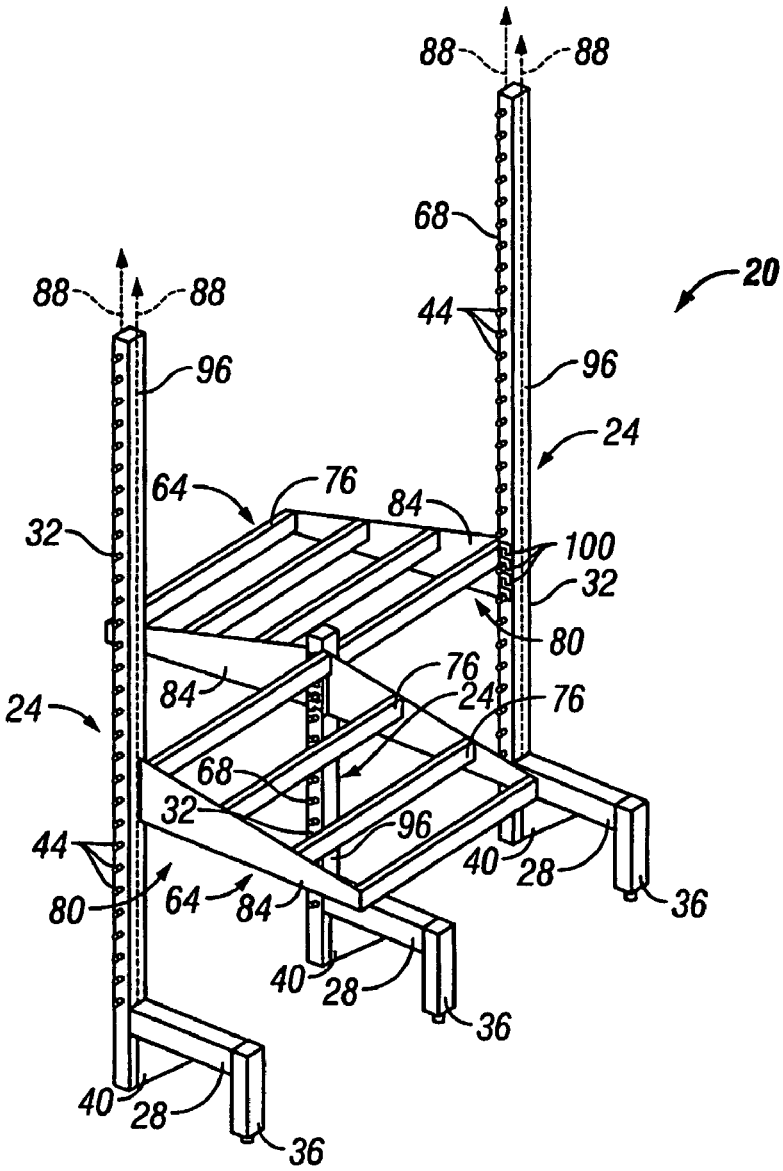
FIG. 10 is a front perspective view of a workstation according to a fourth preferred embodiment of the present invention.
Figure 11:
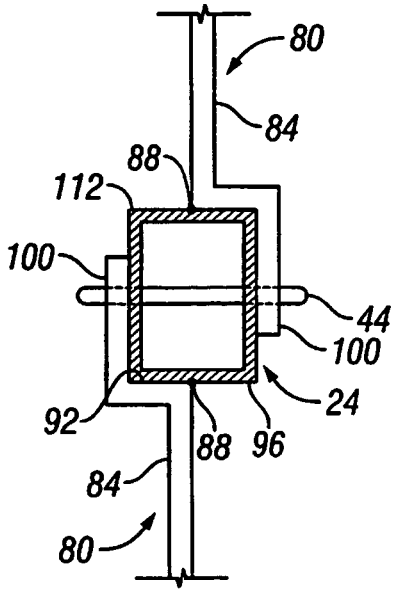
FIG. 11 is a detail sectional view of a shelf bracket and support connection arrangement in the workstation illustrated in FIG. 10, taken along line 11-11 of FIG. 10.

FIGS. 10 and 11 illustrate an alternative embodiment of the present invention in which posts 24 support shelves 64 mounted to the inside and outside surfaces 68, 72 of the posts 24 (similar to the workstation illustrated in FIGS. 8 and 9). However, FIGS. 10 and 11 also show how shelves 64 can be connected to the posts 24 to face in opposite directions. As illustrated in FIGS. 10 and 11, the shelves 64 can even employ the same pins 44 on the posts 24 in such configurations.

Figure 12:
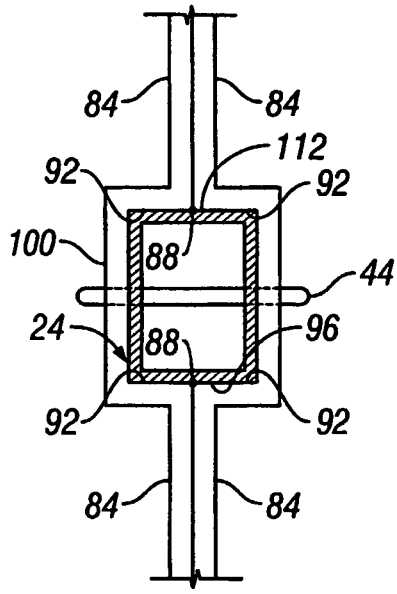
FIG. 12 is a detail sectional view of a shelf bracket and support connection arrangement according to a fifth preferred embodiment of the present invention.

Referring to FIG. 12, some embodiments of the workstation 20 according to the present invention include shelves 64 that can extend from both the front surface 96 of the post 24 and a rear surface 112 of the post 24. Therefore, the workstation 20 has forward and rearwardly-facing shelves 64. The side brackets 80 in such embodiments can take any form discussed above with reference to the earlier-described embodiments. In FIG. 12 for example, both side brackets 80 have flanges 84 that extend away from centerline 88 running along the post 24. Each side bracket 80 in the illustrated preferred embodiment has two bearing surfaces 92: one that contacts the front surface 96 and one that contacts the rear surface 112 to distribute torsional force upon the shelves 64 as described earlier.

Figure 13:
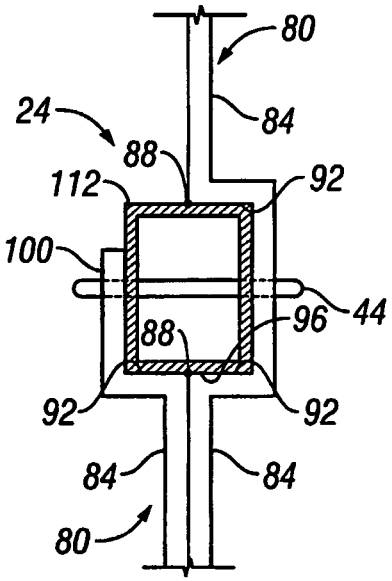
FIG. 13 is a detail sectional view of a shelf bracket and support connection arrangement according to a sixth preferred embodiment of the present invention.

Referring to FIG. 13, some embodiments of the workstation 20 according to the present invention include shelves 64 with different types of brackets 80 that can be mounted to the same post 24. For example, a bracket 80 can be employed that cups a side of the post 24 and extends away from opposite sides of the support post 24 at front and rear centerlines running along the post 24 (similar to the brackets 80 described above and illustrated in FIG. 12). This bracket 80 can share the same support post 24 as a second bracket connected to an opposite side of the support post 24 and that extends away from only one of the centerlines running along the post 24. Because both types of side brackets 80 have flanges 84 that extend generally from the centerlines 88 of the post 24 a substantial gap is not created between the side brackets 80.

Figure 14:
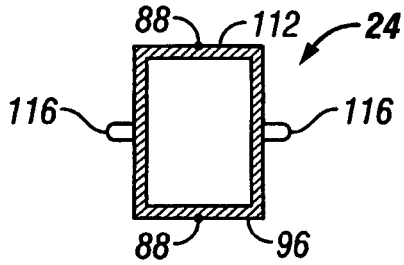
FIG. 14 is a cross-sectional view of an alternative vertical support post according to the present invention.

Referring to FIG. 14, some embodiments of the workstation 20 according to the present invention employ pins 116 incrementally mounted to each of the inside and outside surfaces 68, 72 of the support posts 24. The shelves 64 can mount to the pins 116 in similar fashions as discussed in the above embodiments. Preferably, the pins 116 are welded to the support posts 24. However, the pins 116 can be mounted to the support posts 24 in any other manner as desired. For example, the pins 116 can be mounted to the support posts 24 by friction fitting, fasteners or a keyed connection.

By employing the vertical post, shelf, and bracket structure described above, a number of embodiments of the present invention provide a workstation (or a shelving or rack system) that is highly adjustable, modular, and adaptable to a large number of applications, spaces, and environments. In the various embodiments described above and illustrated in the figures, the use of support posts 24 having pins 44 on opposite sides thereof enables a user to mount shelves 64 on both sides of the posts 24 and to share the same posts 24 with shelves 64 located in adjacent units. In addition, various embodiments of the present invention enable the user to assemble the workstation 20 (or shelving or rack system) as a wall unit, as a free-standing unit with shelves 64 accessible from multiple positions around the workstation 20, and/or as a modular system having multiple side-by-side shelf units with a reduced number of support posts 24 and a smaller footprint. This versatility, coupled with the more reliable and simpler shelf mounting arrangement of the present invention, provides a number of advantages as discussed above.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention. For example (and as described in greater detail above), rather than employ side brackets 80 of two separate shelves 64 extending from the posts 24 in the same direction, the side brackets 80 from the two separate shelves 64 can extend in opposite directions to give the workstation 20 greater modularity and greater freedom to accommodate particular user needs and preferences. As another example (and as also described above) the vertical support posts 24 can include a plurality of pins 116 incrementally mounted to each of the inside and outside surfaces 68, 72 of the support posts 24.

As yet another example, the various elements of the modular workstations 20 are illustrated in the accompanying figures with exemplary shapes. However, these shapes can be different in alternative embodiments of the present invention. By way of example only, the upright members 32 illustrated in the accompanying figures have rectangular cross-sectional shapes (i.e., having readily identifiable front, rear, and lateral sides with respect to the front, rear, and sides of the modular workstations 20), and in some embodiments are defined by 1" tube stock. However, the upright members 32 need not necessarily have rectangular cross-sectional shapes. The upright members 32 can have any other cross-sectional shape desired, including without limitation round and irregular cross-sectional shapes. In this regard, it should be noted that the upright members 32 of in the various embodiments of the present invention still have identifiable front, rear, and lateral sides—regardless of the shape of the upright members 32. Therefore, as used herein and in the appended claims, when a support post or upright member is referred to as having "sides" this is not intended as a limitation on the cross sectional shape of the support post or upright member. Terms such as "front", "back", and "side" are used herein in order to indicate a general area or surface of the support post or upright member. For example, a post with a circular cross-sectional shape can have sides as well as a front and a back even though separate walls defined by corners do not exist.

What is claimed is:

1. A cantilevered shelf releasably connectable to first and second posts at a plurality of different heights along the first and second posts, each post having a front, a rear, and opposed sides, the cantilevered shelf comprising:

a first flange having an end releasably engagable with an exterior surface of one of the opposing sides of the first post, the first flange shaped to extend across less than an entire front width of the first post measured in a lateral direction of the first post to define a bearing surface of the first flange abutting the front of the first post;

a second flange having an end releasably engagable with an exterior surface of one of the opposing sides of the second post, the second flange shaped to extend across less than an entire front width of the second post measured in a lateral direction of the second post to define a bearing surface of the second flange abutting the front of the second post; and a shelf body attached to and extending between the first flange and the second flange;

wherein the first and second posts further comprise a plurality of connectors extending laterally and away from the opposed sides of the posts, the ends of the first and second flanges releasably engagable with at least one connector on the first and second posts, respectively, at different heights along the first and second posts defined at least in part by the locations of the plurality of connectors on the posts, said connectors passing through the end portions of the first and second flanges.

2. The shelf as claimed in claim 1, further comprising a shelf cover attached to the shelf body.

3. The shelf as claimed in claim 1, wherein the shelf body has a surface upon which items supported by the shelf rest.

4. The shelf as claimed in claim 1, wherein the plurality of connectors are pins extending laterally and away from the opposed sides of the first and second posts.

5. The shelf as claimed in claim 4, wherein the pins extend through the first and second posts.

* * * * *